US005530760A

United States Patent [19]

Paisley

[11] Patent Number: 5,530,760

[45] Date of Patent: Jun. 25, 1996

[54] APPARATUS AND METHOD FOR ADJUSTING LEVELS BETWEEN CHANNELS OF A SOUND SYSTEM

[75] Inventor: Ian Paisley, Aurora, Canada

[73] Assignee: Audio Products International Corp., Scarborough, Canada

[21] Appl. No.: 234,693

[22] Filed: Apr. 29, 1994

[51] Int. Cl.[6] ..... H04R 5/00

[52] U.S. Cl. ..... 381/27

[58] Field of Search ..... 381/18, 17–19, 381/20, 63, 22, 24, 27, 104, 109, 119, 21, 23

[56] References Cited

U.S. PATENT DOCUMENTS

| | | | |
|---|---|---|---|
| 2,019,615 | 11/1935 | Maxfield | 381/27 |
| 3,952,157 | 4/1976 | Takahashi et al. . | |
| 4,932,059 | 6/1990 | Fosgate . | |
| 4,980,915 | 12/1990 | Ishikawa | 381/27 |
| 5,043,970 | 8/1991 | Holman . | |
| 5,172,415 | 12/1992 | Fosgate . | |
| 5,189,703 | 2/1993 | Holman . | |
| 5,199,075 | 3/1993 | Fosgate . | |
| 5,222,059 | 7/1993 | Holman . | |
| 5,263,087 | 11/1993 | Fosgate . | |

FOREIGN PATENT DOCUMENTS

| | | | |
|---|---|---|---|
| 0354517 | 2/1990 | European Pat. Off. . | |
| 0630168 | 12/1994 | European Pat. Off. . | |
| 2256400 | 10/1990 | Japan | 381/27 |
| 2154835 | 9/1985 | United Kingdom . | |

OTHER PUBLICATIONS

Ishikawa et al., IEEE Transactions on consumer Electronics, "1988 International Conference on Consumer Electronics, Part 1," vol. 34, No. 3, Aug. 1988, New York, pp. 612–618. Extract from Dolby Surround Manual (Section IV).

*Primary Examiner*—Curtis Kuntz
*Assistant Examiner*—Xu Mei
*Attorney, Agent, or Firm*—Bereskin & Parr

[57] ABSTRACT

Surround sound systems commonly produce, in addition to a surround channel, left, right and center channels. An apparatus is provided for connection between the left, right and center channels to enable the balance between the center channel and the left and right channels to be adjusted. It enables the level of the center channel to be reduced and the center channel to be correspondingly redistributed to the left and right channels to create a phantom center channel from those left and right channels. The degree to which the center channel is reduced in level, and extent to which the center channel is redistributed to the left and right channels are both variable.

8 Claims, 5 Drawing Sheets

APPARATUS AND METHOD FOR ADJUSTING LEVELS BETWEEN CHANNELS OF A SOUND SYSTEM

FIELD OF THE INVENTION

This invention relates to an apparatus and method enabling adjustment of the outputs or channels of a periphonic or surround sound system. More particularly, the invention is concerned with enabling user adjustment of the left, right and centre channels of a known periphonic or surround sound system, to generate a variable acoustic image.

BACKGROUND OF THE INVENTION

Periphonic or surround sound systems have been developed to enhance the performance of soundtracks from movies, videos and the like, and also a variety of audio recordings.

It has been known for some time to record audio material in a stereo format, but this enables only two channels to be recreated. While this is a considerable improvement of even older monorecordings, it still has a lack of depth, or does not give a true three-dimensional sense to the sound.

Recently, a variety of surround sound systems has been developed. These commonly provide a way of encoding a conventional stereo, two channel sound track or recording with information for four channels. In addition to the standard left and right channels, a centre channel and a rear or surround channel are provided.

The surround or rear channel is provided to give an illusion of space or three dimensions, so as to give a greater fullness and directional quality to the sound.

With left and right channels, it is possible to create a phantom or apparent centre channel by simply providing the necessary signals at equal levels to the left and right channels. However, this has proved to be inadequate or to give a poor effect for many purposes.

In particular, when watching a movie or video, when one or more characters are close to the centre of the screen, the user wants to sense that the sound is indeed coming from the centre of the screen.

The provision of a phantom centre channel has proved to be inadequate and ineffective for this purpose. It often does not provide a strong central image. Further, it is highly dependent on a listener being centrally or equidistantly located with respect to the speakers for the left and right channels. Any listener who is displaced from such a position will experience a strong "pulling" effect to one of the left and right speakers, which gives the disconcerting effect that the sound originates from one side or the other.

This problem has been recognized, and for this reason a centre channel is commonly provided in surround sound systems. The intention is to provide a strong central audio image for any audio portion which apparently originates from the centre or close to the centre of the video image. This is commonly implemented by examining the left and right channel signals, and then assuming that any common signal component represents a central image. This common signal component is then supplied to the central channel and subtracted from the left and right channel signals.

This does indeed overcome many of the problems of a phantom centre channel. A listener experiences an audio image that clearly originates from the centre channel, which will commonly be provided by a speaker located immediately above the screen or video image. The "pulling" problem identified above is also absent, since even an off-centre listener will still experience the full effect of the centre channel.

However, an audio image supplied just to the centre channel will lack all sense of spaciousness or depth, and can have a strong one-dimensional effect. When a listener is listening to a soundtrack having many different audio images, this can produce disconcerting or unrealistic effects. Part of the soundtrack, for example background sound effects and the like will be experienced from the left and right channels, and possibly also the rear, surround channel. This often will be interspersed with speech portions originating just from the centre channel, which will give a wholly different effect. The user will thus hear a soundtrack that rapidly alternates between a surround image coming from all speakers and a mono image coming from just the central speaker.

One common and well-known surround sound system is that developed and made available by Dolby Laboratories Corporation. The two sound tracks are specially encoded, and then decoded using appropriate decoders. An active decoder, marketed under the trade name Pro Logic provides the four channels, left, right, centre and surround. While originally conceived for the film industry, such encoding is now commonly provided on video tapes for home usage, and for decoding in home theatres and the like.

Other workers in this field have identified drawbacks and limitations of known periphonic or surround sound system. An example is found in U.S. Pat. No. 5,172,415 (Fosgate). Fosgate recognizes that a well designed decoder system should provide correct separation, localization and placement of individual predominant sound sources. Fosgate is particularly concerned with the generation and use of control signals that determine signal levels to each channel. Fosgate is more particularly concerned with dealing with extreme dynamic conditions, which can cause control signals to vary rapidly, giving unrealistic effects to a listener.

Fosgate also suggests the use of a so-called "Panorama" control. This is particularly concerned with the balance between front and back particularly in automobile use.

Fosgate identifies a problem with FM reception where, if reception fades, a typical car radio will compensate by gradually blending the left and right channels down to mono, as the signal fades. When such a stereophonic signal is applied to a surround process, the signal is, when at full strength, wrapped around the listener. As it collapses to monophonic, the balance shifts to the front, and hence is far more noticeable to the user.

The Panorama control can alleviate this effect by reducing the initial separation if necessary, all the way down to monophonic. An intermediate position on the Panorama control is intended to provide front to rear balance, by varying the degree to which the stereo signal is wrapped around the listener. At another extreme of the control, the signal again becomes monophonic, but is directed to the rear only.

It will be appreciated that while Fosgate identifies a particular problem and solution in a conventional decoder, this is a particular application to varying FM reception. More notably, Fosgate fails to identify any drawbacks or limitations in the conventional split of signals between the left, centre and right channels.

SUMMARY OF THE PRESENT INVENTION

The present inventor has realized that known coding and decoding techniques provide an inadequate distribution or split of an audio image between the front, left and right channels.

It is now therefore realized that this split should be modified, and more particularly, should be provided with the capability of varying the extent to which an original audio image is provided by the central channel, and the complementary extent to which it is provided by a phantom centre channel generated by the left and right channels.

In accordance with the present invention, there is provided an apparatus for enabling adjustment of levels between left, right and centre channels of a sound system, the apparatus comprising: a left channel input; a centre channel input; a right channel input; respective left, centre and right channel outputs; a first, variable level adjustment means enabling a user to adjust the level of the centre channel, connected between the centre channel input and the centre channel output to generate an adjusted centre channel signal; a second level adjustment means; connected to the centre channel input and having user-adjustable variable output, for producing a modified centre channel signal at the output thereof to generate a variable acoustic image; and a summation means connected to the left and right channel inputs, to the output of the second level adjustment means and to the left and right channel outputs for adding the modified centre channel signal to the left and right channel signals.

Preferably, the first level adjustment means is provided by a potential divider, whose output is, in effect, a signal to be subtracted from the original centre channel signal. This is then effected in a centre channel summation amplifier.

The output from the potential divider is amplified and inverted in a further operational amplifier, having a variable feedback resistance, to provide variable gain. The output of this amplifier is then advantageously connected to further operational amplifiers which effect a further inversion and summation with the original input signals, so as to add the centre channel, with its level modified by the level adjustment potential divider and the first amplifier, to the left and right channels respectively.

More preferably, this apparatus can be provided in combination with a decoder for decoding two audio channels of encoded four channel information.

BRIEF DESCRIPTION OF THE DRAWING FIGURES

For better understanding of the present invention, and to show more clearly how it may be carried into effect, reference will now be made by way of example, to the accompanying drawings, which are a preferred embodiment of the present invention, and in which.

DETAILED DESCRIPTION OF INVENTION

Figure 1:
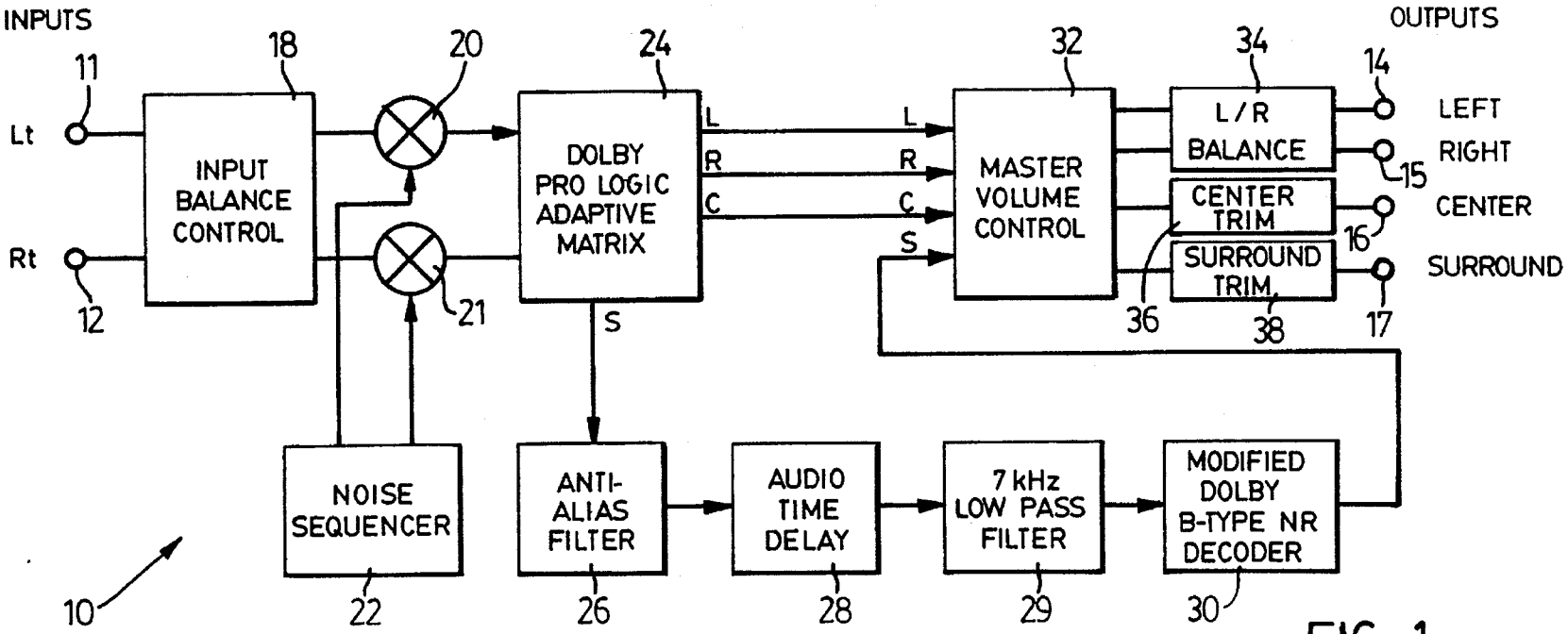
FIG. 1 is a block diagram of a conventional decoder.

FIG. 1 shows a block diagram of a decoder generally indicated by the reference 10. Decoder 10 has inputs 11 and 12 for left and right signals, encoded to include a front-to-back sound field dimension. As outputs, it has a left channel 14, a right channel 15, a centre channel 16 and a surround channel 17. In practice, the surround channel 17 could provide both left and right rear channels.

The decoder 10 could take a variety of forms, and the decoder shown in FIG. 1 is intended to provide an active surround decoder for the Dolby Surround Pro Logic System. Dolby is a trademark of Dolby Laboratories Licensing Corporation. As explained in greater detail below, this invention is applicable to any encoding and decoding scheme which provides for separate left, right and centre channels at least.

Here, the decoder 10 is adapted to work with specially encoded audio soundtracks, for example as found on Dolby Stereo movies or Dolby Surround video productions, or other recordings, to provide a front-to-back surround field dimension, intended to compliment the left-to-right dimension of conventional stereo recordings. While passive decoders can be used, they do not provide a central channel, which is necessary for the present invention. Active decoders, marketed under the trade name Pro Logic by Dolby Laboratories Licensing Corporation use directional enhancement techniques and provide an additional centre channel, necessary for the present invention. Such decoders are described in detail in U.S. Pat. Nos. 3,632,886; 3,746,792 and 3,959,590, the contents of which are hereby incorporated by reference.

The audio material is preferably encoded using Dolby MP (Motion Picture) matrix encoding to permit the recording of multi-dimensional four-channel material on a standard two channel or soundtrack.

The decoder shown in FIG. 1 can be used additionally with conventionally mixed stereo soundtracks.

The decoder 10 performs a number of separate functions. An input balance control 18 receives the inputs 11, 12 and corrects for channel balance errors that may exist in the audio signal. This is vital to ensure that the matrix section gives optimum results. As only mild levels of correction are needed a control providing as little as ±6 dB of range will be effective.

The separate left and right input channels are then passed through respective switching devices 20, 21, which have alternate inputs connected to a noise sequencer 22. The noise sequencer is intended for providing a sequenced noise input, for setting up the system and ensuring the appropriate levels on each channel. Switches 20 and 21 are then connected to an adaptive matrix decoder 24, which is described in greater detail in relation to FIG. 2. It has outputs indicated at L, R and C for the left, right and centre channels, and an output at S for the surround channel.

The surround channel output is connected through an anti-alias filter 26, to prevent spurious beat products, which in turn is connected to an audio time delay unit 28. This can be implemented in a variety of ways. A delay time of 20 milliseconds is required, but, for improved adjustability in the system, the delay may be adjustable for 15 to 30 milliseconds in several steps.

A low pass filter 29, improves processor tracking by preventing high-frequency audio signals from entering the decoder. It should have at least a 12 dB per octave slope above the breakpoint.

The output of the unit 29 is connected to a modified Dolby B-type noise reduction decoder 30.

The four channels are then passed through a master volume control 32, whose outputs are connected to a left/ right balance control 34, a centre channel trim level control 36 and a surround trim level control 38.

Figure 2:
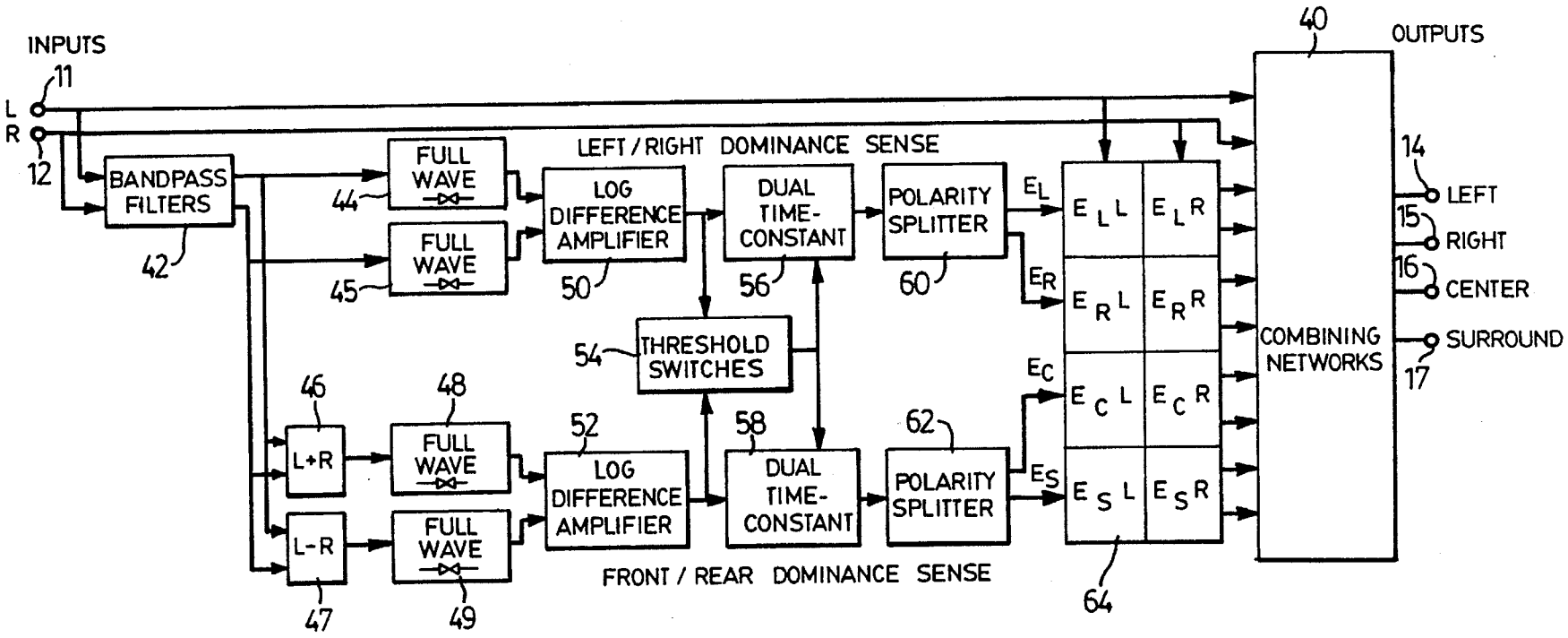
FIG. 2 shows an adaptive matrix decoder for use in the decoder of FIG. 1.

Referring to FIG. 2, the adaptive matrix decoder is the heart of the active decoder. Its function is to continuously analyze the two-channel matrixed audio input to determine the direction and relative magnitude of the encoded sound field to determine the signals for each channel. Once the direction and relative magnitude have been determined, the circuit proportionately cancels crosstalk signals to expose the dominant signals of the soundtrack, to improve directional localization.

At the output there is a combining network 40 to which the two inputs are directly connected.

The inputs are also connected to Band Pass Filters 42 having outputs connected to full-wave rectifiers 44 and 45 and to Summation Units 46 and 47. The Summation Units 46 and 47 in turn have outputs connected to two full-wave rectifiers 48 and 49.

The rectifiers 44 and 45 are connected to a log-difference amplifier 50, while the rectifiers 48 and 49 are connected to a log-difference amplifier 52.

The log-difference amplifiers 50, 52 are connected to threshold switches 54 and to respective dual time constant units 56 and 58. Threshold switches 54 are also connected to these time constant units 56 and 58, for control.

The time constant units 56 and 58 have outputs connected to respective Polarity Splitters 60 and 62 which have four outputs connected to 8 voltage controlled amplifiers indicated at 64.

In effect, the Polarity Splitter 60 produces outputs $E_L$ and $E_R$ for the levels for the left and right signals. Corresponding, the Polarity Splitter 62 produces signals $E_C$ and $E_S$ for the centre and surround levels.

In the voltage controlled amplifiers 64, these level signals are used to control the amplification of the input left and right signals to produce 8 output signals, connected to the combining network 40. In the combining network 40, these signals and the two original left and right input signals are combined in the various proportions to give the output left, right, centre and surround channel signals.

Again, it is noted that the basic decoding of the left and right signals to produce the left, right, centre and surround channel outputs is conventional and any suitable decoder can be employed.

Figure 3:
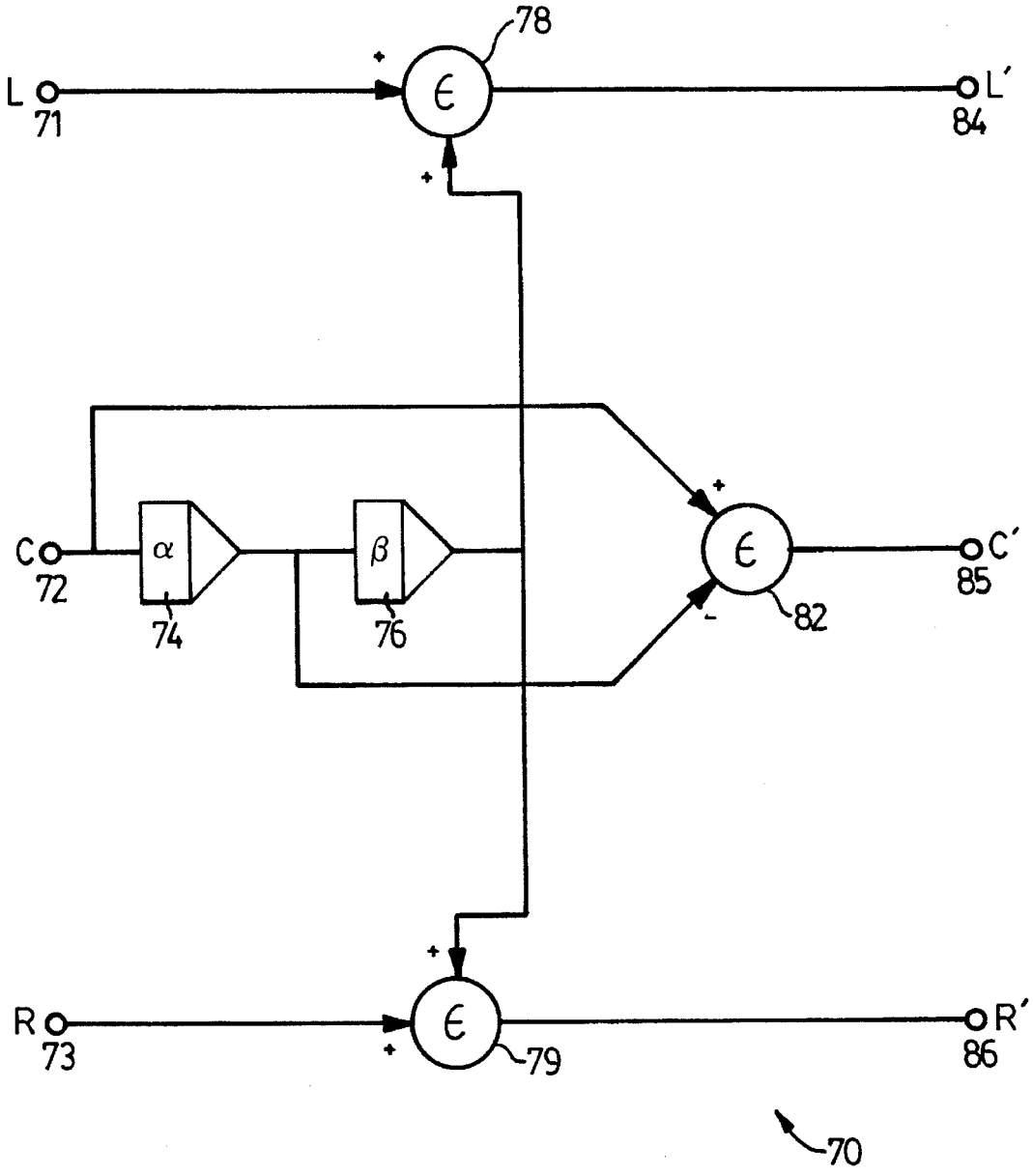
FIG. 3 is a schematic diagram of a first embodiment of a balancing apparatus in accordance with the present invention.
Figure 4:
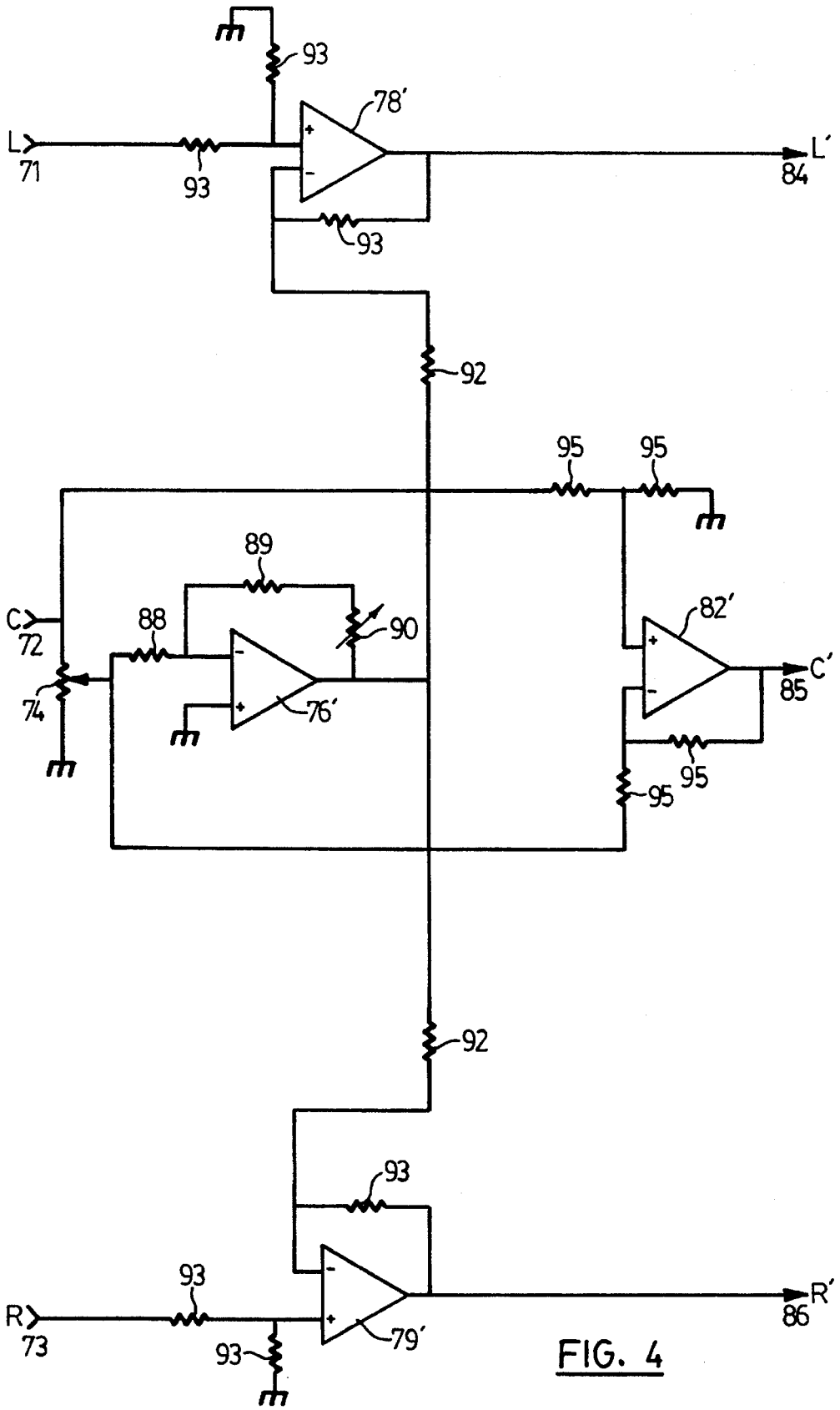
FIG. 4 is a detailed diagram of the balancing circuit of FIG. 3.

Turning to FIGS. 3 and 4, these show a block diagram of a balance circuit or apparatus in accordance with the present invention and a detailed circuit.

Referring first to FIG. 3, the apparatus and circuit is indicated generally by the reference 70 and has inputs 71, 72 and 73 for the left, centre and right channels respectively.

The centre channel is connected to a level adjustment device 74, which in turn is connected to a first amplifier 76, intended to compensate for different efficiencies etc. between the centre and side channel speakers. For an input signal C, the level adjustment device 74 modifies the signal by a factor α to give an output αC, and the first amplifier 76 has a gain of β to give at its output αβC. The output of first amplifier 76 is connected to respective summation devices 78 and 79, also having inputs connected to the left and right inputs 71, 73 respectively. It will be appreciated that the outputs L' and R', the outputs 84, 86 are given by:

$$L'=L+\alpha\beta C$$

and $$R'=R+\alpha\beta C$$

For the centre channel, a final centre summation device 82 receives the original centre channel signals C and the output from the level adjustment device 74, so that the adjusted or centre channel signal C' is given by:

$$C'=(1-\alpha)C$$

Referring to FIG. 4, a detailed implementation is shown, utilizing operational amplifiers. For simplicity, like components in FIGS. 3 and 4 are given the same reference numeral.

Here, the level adjustment device 74 comprises a potential divider. The first amplifier 76 comprises an operational amplifier indicated at 76' provided with an input resistor 88 and feedback resistors 89, 90, connected to its inverting input. Resistor 90 is adjustable and essentially sets the value of β. For the values indicated, β would be adjustable in the range of 0.5–2. In known manner, the positive input of the amplifier 76' is grounded.

The operational amplifier 76' thus has an inverted output of −αβC. This is connected through resistors 92 to the inverting inputs of further operational amplifiers 78', 79' forming the summation devices for the left and right channels. Additional resistors 93 cause the original left and right signals to be added to the inverted output from the amplifier 76', thus giving the appropriate function.

The centre summation device 82' is a further operational amplifier having an appropriate resistor array 95 that has the original centre channel signal C connected to the non-inverting input and the adjusted signal αC connected to the inverting input to give it the function necessary for C' at its output.

It will be appreciated that the factor α can be adjusted between 0 and 1, and can be used to alter the adjusted centre channel C'. As α is increased towards 1, the adjusted centre channel C' reduces, and falls to 0 when α equals one.

Correspondingly, the value of β can be adjusted to alter the proportion of the centre channel redistributed equally to the left and right channels. With β at its minimum value of 0.5, then the signal removed from the centre channel, i.e. αC is, in effect, such that the potential added to the L and R channels equals the reduction in the centre channel level. As β is increased, the proportion of the centre channel supplied to the left and right channel is increased.

In practice, a decoder device would be provided with two extra controls for the quantities α and β. These could be adjusted by the user to give a desired performance. This will depend upon a user's preferences, the material being played, and the set up of the audio and video equipment.

Figure 5:
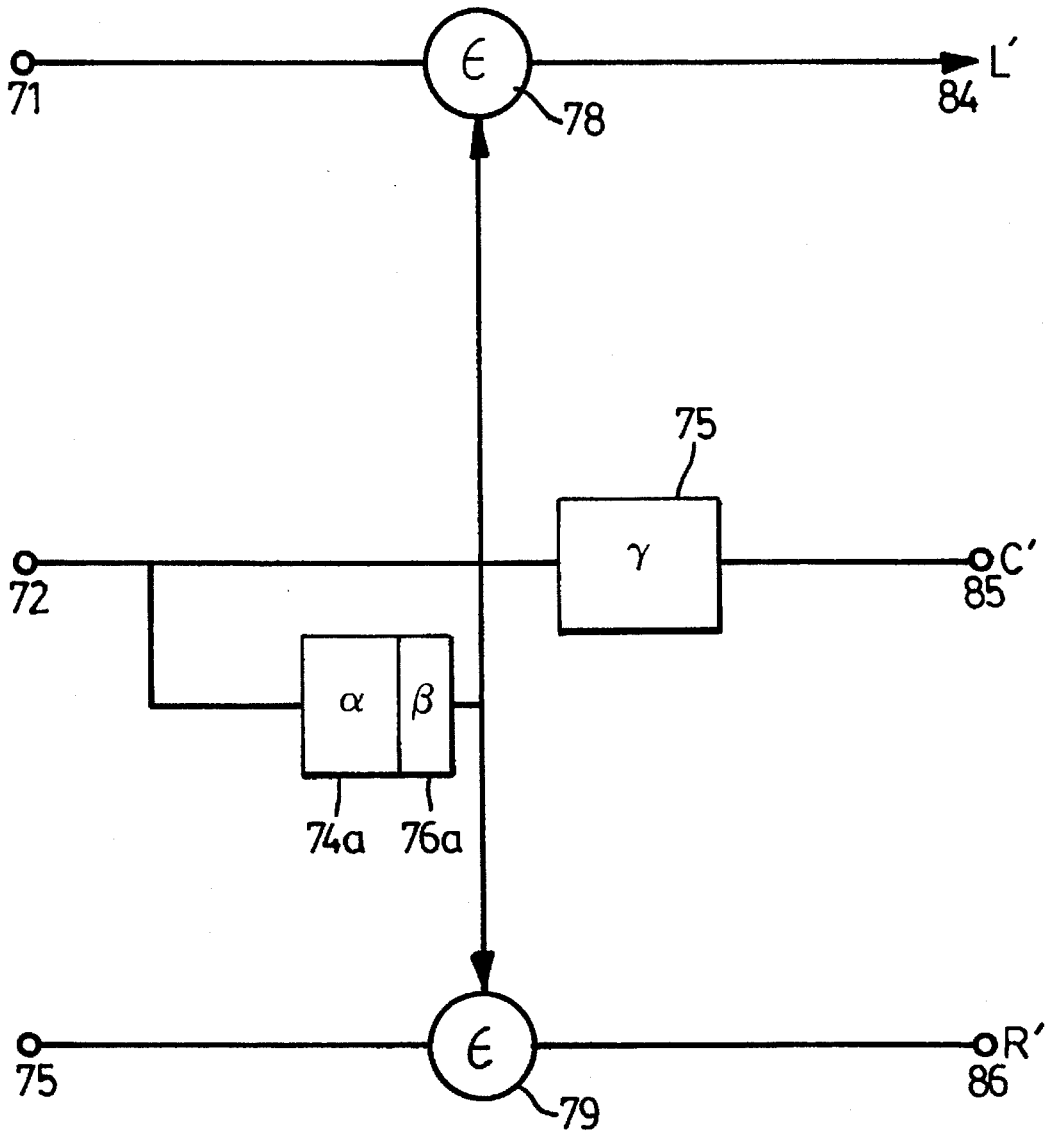
FIG. 5 is a schematic diagram of a second embodiment of a balancing apparatus in accordance with the present invention.

Referring now to FIG. 5, shown schematically as a second embodiment of the invention. For simplicity, the inputs 71–73 and outputs 84–86 are given these same reference numerals. Also, the summation devices 78 and 79 are given the same reference. Other elements are denoted by the subscript a, to indicate a modified function.

Here, the level adjustment device **74*a* and the first amplifier 76*a* are provided in series together. Separately, there is a centre channel level adjustment device 75 connected to the centre channel output 85**.

In this embodiment, it has been realized that, in a reverberant environment, the actual acoustic signals generated by the speakers associated with the left, centre and right channels may not be correlated. As such, simply maintaining the sum of the voltage levels of the centre channel and the side channels, for the original centre channel signal, will not maintain a constant loudness level for the centre channel image. This might be achieved, if the signals were strongly correlated. As is known, for uncorrelated signals, the power level is proportional to the square of the signal applied to each speaker. Hence, the inventors realized that it is the sum of the squares of the potentials for the centre channels and the side channels, representing the centre channel signal, which should be maintained constant.

Put another way, if the level adjustment device 74*a* affects the level adjustment by a factor $\alpha$ and the level adjustment device 75 affects the level adjustment by a factor $\gamma$, then the levels $\alpha$ and $\gamma$ are related by the following equation:

$$\alpha^2\gamma^2=1$$

Practically, this can be implemented by the use of ganged potentiometers with an appropriate resistance taper. The potentiometers would work in reverse, so that as the level of one is increased, the level of the other is decreased.

It would therefore be appreciated that if $\alpha$ is equal to 0.707,(1/√2) then $\gamma$ must be equal to 0.707, so that the above equation is met.

The amplifier 76*a* then serves the function of the amplifier of the level to the side channels, to allow for the different efficiencies in characteristics of the side channel speakers as compared to the centre channel speakers.

In practice, it has been found that the level of adjustment 76*a* could be set, depending upon the characteristics of the speaker, and then should need no further adjustment. A gang control for the level adjustment devices 74*a*, 75 can then be operated to switch the centre channel between the real centre channel and the phantom centre channel as desired. By maintaining, the levels as outlined above, the levels received by the listener remains substantially constant. Hence, no adjustment of the amplifier 76A should be required, as the proportion of the centre channels switched to the side channels is varied.

The setting of the controls will also depend upon the number of people listening to the material and the location. Thus, for a single user located equidistant from the left and right channels, then the centre level channel can be reduced considerably, and greater reliance placed on a phantom centre channel, to give greater depth to the sound. On the other hand, for a large number of users, some of whom may be well away from the an ideal listening location, i.e. they may be much closer to one of the left and right channels, then a higher level can be maintained for the centre channel, to reduce any pulling tendency towards one side or the other for such listeners.

In general, where the user wishes to experience a strongly centralized signal, the centre channel can be maintained at a high level (low $\alpha$ and $\beta$ for FIG. 3, or low $\alpha$, high $\gamma$ in FIG. 5). On the other hand, to give a greater breadth to any signal that would otherwise come through the centre channel, the adjusted centre channel level C' can be reduced, and greater reliance placed on an effective or phantom centre channel produced by the left and right channels combined. In other words, $\alpha$ and $\beta$ can be set relatively high in FIG. 3 or $\alpha$ set high and $\gamma$ low in FIG. 5.

I claim:

1. An apparatus for enabling adjustment of levels between left, right and centre channels of a sound system, the apparatus comprising: a left channel input; a centre channel input; a right channel input; respective left, centre and right channel outputs; a first continuously variable level adjustment means enabling a user to adjust the level of the centre channel, connected between the centre channel input and the centre channel output, to generate an adjusted centre channel signal; a second continuously variable level adjustment means connected to the centre channel input and having a user-adjustable variable output, for producing a modified centre channel signal at an output thereof to generate a variable acoustic image; and a side channel summation means connected to the left and right channel inputs, to the output of the second level adjustment means and to the left and right channel outputs for adding the modified centre channel signal to the left and right channel signals, wherein both of the first and second level adjustment means effect the full frequency range of the center channel signal.

2. An apparatus as claimed in claim 1, wherein the first and second level adjustment means are infinitely variable and adjust the level of the centre channel signal by a first factor and second factor respectively, wherein the first and second level adjustment means are interconnected such that first and second factors are related, and wherein the sum of the squares of the first and second factors is maintained constant.

3. An apparatus as claimed in claim 2, wherein the first and second level adjustment means are ganged together and are adjustable together.

4. An apparatus for enabling adjustment of levels between left, right and centre channels of a sound system, the apparatus comprising: a left channel input; a centre channel input: a right channel input; respective left, centre and right channel outputs; a first, variable level adjustment means enabling a user to adjust the level of the centre channel, connected between the centre channel input and the centre channel output, to generate an adjusted centre channel signal; a second level adjustment means connected to the centre channel input and having a user-adjustable variable output, for producing a modified centre channel signal at an output thereof to generate a variable acoustic image; and a side channel summation means connected to the left and right channel inputs, to the output of the second level adjustment means and to the left and right channel outputs for adding the modified centre channel signal to the left and right channel signals, wherein a centre channel summation means has an input connected to the centre channel input and an inverting input connected to the output of the first level adjustment means, the output of the centre channel summation means being the centre channel output and being the original centre channel signal minus the adjusted centre channel signal.

5. An apparatus as claimed in claim 4 wherein the side channel summation means comprises respective left and right summation devices, each of which has an input connected to the respective one of the left and right inputs, an input connected to the output of the second level adjustment means and an output connected to the respective one of the left and right channel outputs.

6. An apparatus as claimed in claim 5 wherein the first level adjustment means comprises an infinitely variable potential divider connected to the centre channel input and having a ground connection, and wherein the second level adjustment means comprises a first operational amplifier having an inverting input connected by a resistor to the first level adjustment means, and a feedback loop from its output to the inverting input including an infinitely variable resistor, providing the variable gain.

7. An apparatus as claimed in claim 6, wherein the centre channel summation device comprises a centre channel operational amplifier, resistors connecting the non-inverting input of that amplifier to ground and to the centre channel input, and resistors providing a connection between the inverting input of that amplifier to the output thereof and to the first level adjustment means, the output of the centre channel amplifier forming the centre channel output, and wherein the summation device for each of the left and right hand channels comprises a respective operational amplifier having an inverting input connected to the output of the first amplification means, a resistor providing negative feedback between the output thereof and the inverting input, and resistors connecting the non-inverting input thereof to both ground and the respective one of the left and right channel inputs.

8. An apparatus as claimed in anyone of the claims 1 to 3, in combination with a decoder having first and second inputs, and left, right and centre channel outputs.

* * * * *